United States Patent [19]

Vasterink

[11] Patent Number: 4,749,904

[45] Date of Patent: Jun. 7, 1988

[54] CATHODE RAY TUBE WITH AN ION TRAP INCLUDING A BARRIER MEMBER

[75] Inventor: Johannes H. A. Vasterink, Almelo, Netherlands

[73] Assignee: U.S. Philips Corporation, New York, N.Y.

[21] Appl. No.: 5,514

[22] Filed: Jan. 16, 1987

[30] Foreign Application Priority Data

Jan. 20, 1986 [NL] Netherlands ..... 8600098

[51] Int. Cl.[4] ..... H01J 29/04; H01J 29/84

[52] U.S. Cl. ..... 313/424; 313/444; 313/446

[58] Field of Search ..... 313/423, 424, 445, 446, 313/444

[56] References Cited

U.S. PATENT DOCUMENTS

| | | | |
|---|---|---|---|
| 4,075,533 | 2/1978 | Janko | 313/424 X |
| 4,350,924 | 9/1982 | Misono | 313/445 X |
| 4,682,074 | 7/1987 | Hoeberechts et al. | 313/446 X |

FOREIGN PATENT DOCUMENTS

| | | | |
|---|---|---|---|
| 2169132A | 7/1986 | United Kingdom | 313/424 |

*Primary Examiner*—David K. Moore
*Assistant Examiner*—K. Wieder
*Attorney, Agent, or Firm*—Robert J. Kraus

[57] ABSTRACT

Positive ions generated in a vacuum tube (1) which may detrimentally influence the electron emission of a cathode (3) are trapped by a plate (35). The plate is present in an aperture (36) in a grid (37) to which it is connected via bars (40). The aperture (36) is sufficiently large to pass the generated beam (6), while the bars (40) hardly influence the beam intensity.

9 Claims, 2 Drawing Sheets

CATHODE RAY TUBE WITH AN ION TRAP INCLUDING A BARRIER MEMBER

BACKGROUND OF THE INVENTION

The invention relates to a device for picking up or displaying pictures, comprising a cathode ray tube having a target in an evacuated envelope and at least one cathode. The cathode emits electrons in an annular beam, and the tube includes at least one first grid having an aperture for passing the beam at a cross-over area in the beam.

In a device for picking up pictures the cathode ray tube is a camera tube and the target is a photosensitive layer such as, a photoconducting layer. In a device for displaying pictures the cathode ray tube may be a picture tube, whilst the target comprises a layer or a pattern of lines or dots of fluorescent material. Such a device may also be adapted for electronlithographic or electronmicroscopic uses.

Netherlands Patent Application No. 7905470 (corresponding to U.S. Pat. Nos. 4,303,930 and 4,370,797), open to public inspection, shows a cathode ray tube having a so-called "cold cathode". The operation of this cathode is based on the emission of electrons from a semiconductor body in which a pn junction is operated in the reverse direction in such a manner that avalanche multiplication of charge carriers occurs. Some electrons may then obtain as much kinetic energy as is required to exceed the electron work function; these electrons are then liberated on the main surface of the semi-conductor body and thus supply an electron current.

Since residual gases always remain in the evacuated envelope, negative and positive ions are liberated from these residual gases by the electron current. The negative ions are accelerated into the direction of the target. In the case of electrostatic deflection they may impinge upon a small area of the target and damage it or disturb its operation. Ion traps are used to prevent this harmful effect. An ion trap for negative ions is known, for example, from U.S. Pat. No. 2,913,612.

A proportion of the positive ions travels in the direction of the cathode under the influence of accelerating and focussing fields prevailing in the tube. If no special measures are taken, some of these ions will impinge on the semiconductor cathode and damage it.

This damaging effect may cause a gradual sputtering of a possibly present layer of material for decreasing the electron work function such as, for example, cesium. The emission properties of the cathode change owing to a re-distribution or even complete disappearance of this material. If this layer is not present (or is completely removed by the above-mentioned sputter mechanism) even the main surface of the semiconductor body may be attacked. In a semiconductor cathode employing avalanche multiplication of charge carriers, as described in Netherlands Patent Application No. 7905470, in which the emitting pn-junction is parallel to the main surface and is separated therefrom by a thin n-type surface zone, this surface zone may disappear completely as a result of this gradual sputtering, so that the cathode no longer functions. In a similar type of cold cathode as described in Netherlands Patent Application No. 7800987 (corresponding to U.S. Pat. No. 4,259,678) laid open to public inspection on 31 July 1979, the pn junction is exposed at the main surface of the semiconductor body. As a result of the above-described damaging effect of positive ions present in the electron tube, for example, the place where the pn junction is exposed on the main surface may change. This causes an unstable emission behaviour.

In a second type of cathode ray tube in which a pn junction is operated in the forward direction in the semiconductor cathode, the so-called negative electron affinity cathode (NEA-cathode), the emission behavior is also influenced because sputtering again takes place. Here too, the layer of material for decreasing the electron work function is first sputtered off gradually. Subsequently the pn-type surface zone of the cathode is attacked until the cathode no lnoger functions. Similar problems apply to other semiconductor cathodes such as, for example, the semiconductor cathodes as described in British Patent Applications No. 8133501 (corresponding to U.S. Pat. No. 4,516,146) and No. 8133502 (corresponding to U.S. Pat. No. 4,506,284).

It is found that the lifetime of cathode ray tubes manufactured with such semiconductor cathodes is considerably shorter owing to the above-mentioned processes.

A device of the type mentioned in the opening paragraph in which the annular emission pattern is obtained with the aid of a conventional thermionic cathode is known from French Patent Specification No. 1,361,143 (corresponding to U.S. Pat. No. 3,250,963).

A kind of sputtering may also take place in conventional cathodes, for example, with barium as a cathode material. It is true that the loss of barium is compensated by the supply of extra barium, but the electron emission becomes less stable owing to the inhomogeneous attack (sputtering) by the positive ions.

SUMMARY OF THE INVENTION

It is an object of the invention to provide a device of the type described in the opening paragraph in which these drawbacks are completely or partly obviated in that a stream of positive ions is substantially completely trapped prior to its reaching the cathode.

To this end a device according to the invention is characterized in that it comprises at least one extra grid having a plate within an aperture for passing the electron beam at the area of an axis at right angles to the emitting surface, which axis substantially coincides with the axis of the annular pattern, said plate being oriented substantially perpendicularly to said axis.

The invention is based on the recognition that due to this measure substantially no positive ions which are generated in the tube part beyond the extra grid impinge on the cathode. It is also based on the recognition that in semiconductor cathodes having a suitably chosen geometry of the emitting part only a fraction of the ions generated between the cathode and the first grid, which moreover have a low energy, contributes to the sputtering action.

The plate in question is preferably connected to the extra grid by means of one or more bars having a width or a diameter of not more than 100 micrometers. It is true that a part of the electron current (approximately 10%) is intercepted thereby, but this does not substantially affect the quality of the image of the electron source on, for example, a phosphor screen if the cathode ray tube is used as a display device.

Although the dimensions of the aperture in the extra grid and the plate are mainly determined by the position of the extra grid in the cathode ray tube and the diameter of the annular pattern; in practice the diameter of the plate is preferably between 50 and 500 micrometers.

This diameter is preferably chosen to be larger than the diameter of the aperture in the first grid so that substantially no highly energetic ions can pass this aperture.

A preferred embodiment of a device according to the invention is characterized in that the cathode comprises a semiconductor body having at least one electron-emitting region on one main surface, which region, viewed in projection, is located completely outside the aperture in the first grid. In such an embodiment a possible influence by highly energetic ions which are generated beyond the electron lens and yet pass the grids is substantially negligible.

In addition, such a semiconductor cathode may be advantageously manufactured in such a manner that the electrons are emitted essentially from a circular cross-over, with a slight spread around a given angle, which is advantageous from an electron-optical point of view. As the electrons move, as it were, alongside the surface of a cone, the electrical brightness is decreased to a lesser extent by lenses having a spherical aberration.

A semiconductor cathode as described in the Netherlands Patent Application No. 7905470 is preferably used for this purpose, but other semiconductor cathodes are alternatively possible such as, for example, NEA cathodes or the cathodes described in the Netherlands Patent Application No. 7800987 or in the British Patent Applications No. 8133501 and No. 8133502.

BRIEF DESCRIPTION OF THE DRAWING

The invention will now be further described with reference to an embodiment and a drawing in which.

DESCRIPTION OF THE PREFERRED EMBODIMENT

Figure 1:
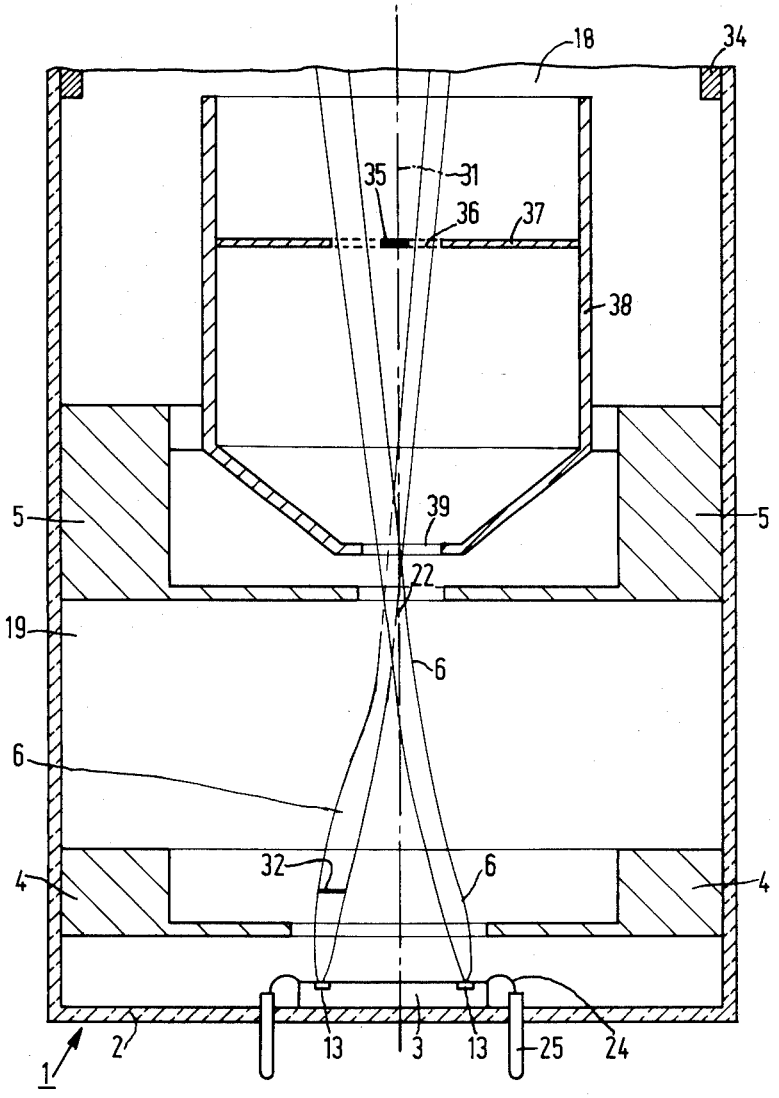
FIG. 1 diagrammatically shows in section a part of a device according to the invention.

The Figures are not to scale and for the sake of clarity particularly the dimensions in the direction of thickness have been greatly exaggerated in the sectional views. Semiconductor zones of the same conductivity type are generally shaded in the same direction. In the Figures corresponding parts are generally indicated by the same reference numerals.

FIG. 1 shows a part of a device 1, in this example a cathode ray tube having a cathode 3 within an envelope 2, in this example a semiconductor cathode in which emission of electrons is obtained by means of avalanche multiplication of electrons in a reverse-biased pn junction. Furthermore the cathode ray tube comprises a first grid 5 and a grid 4 which, if connected to the correct voltages, constitute a positive lens with the cathode 3 from an electron-optical point of view. The part of the cathode ray tube 1 not shown is provided with a target and with conventional means to deflect an electron beam 6 generated in the cathode 3. The electron-emitting regions are diagrammatically shown in FIG. 1 by means of the reference numerals 13. The device 1 may also constitute an independent part of a cathode ray tube or an electron microscope.

In this example electrons are generated in the semiconductor cathode 3 in an annular pattern. To this end the cathode 3 consists of a semiconductor body 7 (see FIG. 2) having a p-type substrate 8 of silicon in which an n-type region 9, 10 is provided which consists of a deep diffusion zone 9 and a thin n-type layer 10 at the area of the actual emission region. In order to reduce the breakdown-voltage of the pn-junction between the p-type substrate 8 and the n-type region 9, 10 in this region, the acceptor concentration in the substrate is locally increased by means of a p-type region 11 provided by ion implantation. Therefore electron emission is effected within the annular zone 13 left free by the insulating layer 12 where the electron-emitting surface is also provided with a mono-atomic layer of a material 33 decreasing the electron work function such as cesium. If necessary, an electrode 14 for accelerating or deflecting the emitted electrons may be provided on this insulating layer 12 of, for example, silicon oxide. Such an electrode may alternatively be used to protect the underlying semiconductor body from charge effects which may occur when positive ions or deflected electrons impinge upon this semiconductor body. The substrate 8 is contacted, for example, via a highly doped p-type zone 16 and a metallization 17, while the n-type region is connected via a contact metallization (not shown). The regions to be contacted are connected in their assembled condition (see FIG. 1), for example, via connection wires 24 to lead-throughs 25 in the wall 2. For a more detailed description of the semiconductor cathode 3 reference is made to the Netherlands Patent Application No. 7905470.

The electrons generated by the cathode 3 are accelerated by the grids 4 and 5. Since the grid 4 has a low or even negative voltage during operation and the grid 5 (diaphragm) has a positive voltage, these grids constitute a positive lens together with the cathode from an electron-optical point of view, which lens causes the annular electron beam generated in the zone 13 to converge to a cross-over, 22. This cross-over which is approximately at the area of the aperture in the first grid 5 (diaphragm) functions as a real source for the actual electron beam which is subsequently deflected and accelerated, for example, by electromagnetic means.

The cross-over 22 has a given dimension at the area of the aperture in the first grid 5. This dimension determines the minimum diameter of the aperture in this grid 5, whereas the maximum diameter is determined by, and is less than, the internal diameter of the annular region 13 where electron emission takes place, which in this example is approximately 200 micrometers.

In the present example the grid 4 is operated at a voltage of 0 Volt, whereas a voltage of 265 Volts is applied to the grid 5. The cross-over 22 then has a diameter of 40 to 50 micrometers. A diameter of, for example, 100 micrometers is chosen for the aperture in the first grid 5.

If positive ions are generated in the envelope 2 by collision of electrons or by other means, these ions are accelerated into the direction of the cathode 3. The electrons generated by the cathode 3 mainly move along the surface of the hollow beam 6. This beam is deflected in the high voltage part for which deflection electrodes 34 are partly shown, while the cross-over 22 is imaged as a dot on the target and impinges upon, for example, a phosphor screen.

High energy positive ions may be liberated in the part 18 between the cross-over 22 and the target. A great many thereof will move substantially along the axis 31 and, if no special measures are taken, they will impinge upon the cathode 3. These ions may impinge upon the metal layer 14 (or possibly the oxide layer 12) so that this layer is attacked by sputtering. The said positive ions may also impinge on the emitting region 13 due to the prevailing fields as a result of the voltages at the grids 4, 5. The lifetime of such a semiconductor cathode is thereby considerably reduced.

Figure 3:
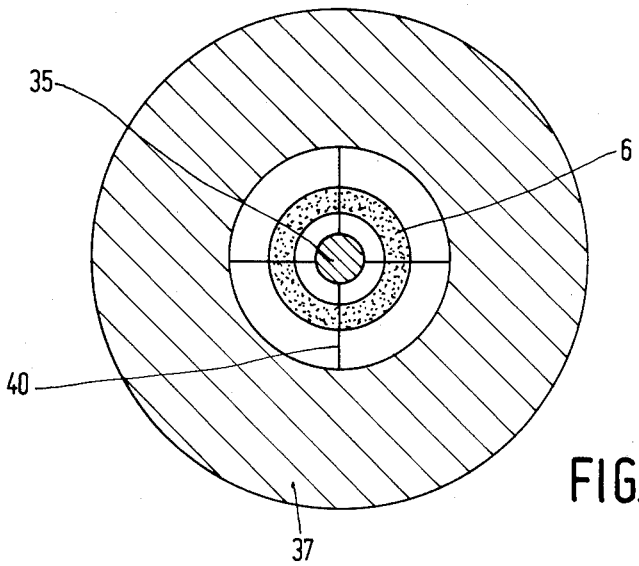
FIG. 3 is a plan view of the extra grid.

According to the invention, the high energy positive ions are trapped by a metal plate 35 which is present in an aperture 36 in a metal grid 37 which forms part of a bush 38 in this example. The bush is open on its side facing the target and in this example it is tapered in the direction of the cross-over 22. At its tapered end the bush 38 has an aperture 39 for passing the electron beam 6. In this example the apertures 36 and 39 have diameters of approximately 3 mm and approximately 1 mm, respectively. The plate 35 is connected via thin bars 40 (width approximately 50 micrometers) to the grid 37 (see FIG. 3) and in this example it has a diameter of approximately 300 micrometers. Dependent on the position in the bush this diameter may vary but in practice it remains limited to a region of from 50 to 500 micrometers. In the relevant example the bars 40 intercept approximately 10% of the beam current but this has hardly any effect on the quality of the image (spot quality).

In the example of FIG. 1 the bush 38 (and hence the grid 37) has a voltage of approximately 1200 V and the high voltage electrode 34 has a voltage of approximately 12 kV. It is found that at these voltages substantially all high energy positive ions follow paths along the axis 31 and are thus trapped by the plate 35 which in this example is substantially at right angles to the axis of the tube, which axis coincides with the axis of the annular emitting pattern.

Figure 2:
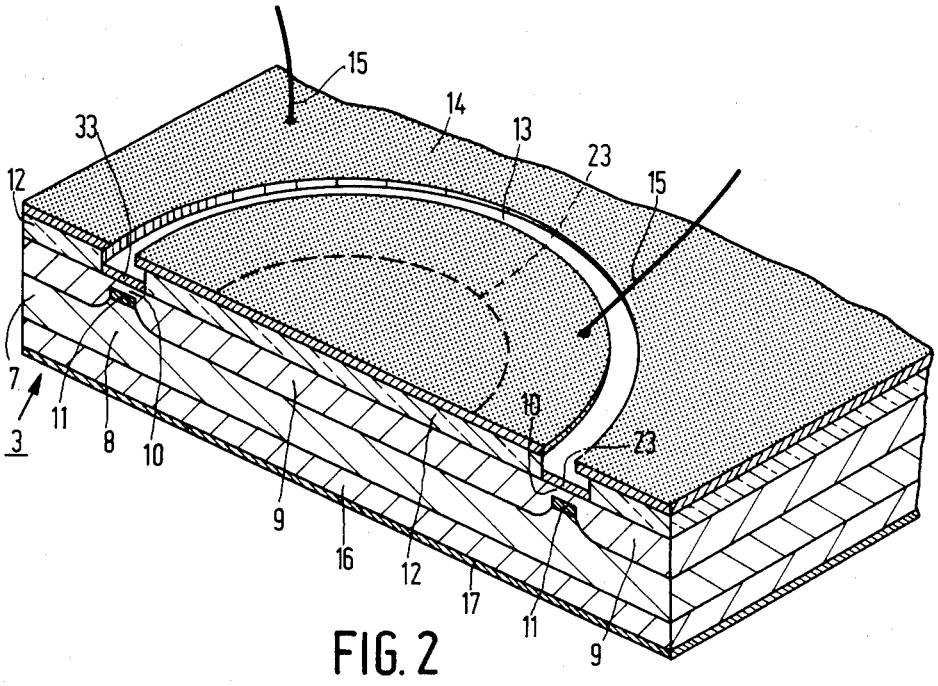
FIG. 2 shows, partly in cross-section and partly in a plan view, a semiconductor cathode for use in such a device.

Any positive ions passing through the gap between the grid 37 and the plate 35 are trapped by the first grid 5. Positive ions generated in the beam 6 between the grid 37 and the cross-over 22 are accelerated substantially parallel to the axis 31 of the tube, pass through the aperture in the grid 5 and impinge upon the cathode 3 in a region which is located within the emitting region 13 and is indicated in FIG. 2 by means of broken lines 23. Therefore the emission behavior is not detrimentally influenced, but it is preferred to provide the semiconductor cathode, as in this example, with an electrode 14 protecting the underlying semiconductor body from charge effects. Therefore the electrode 14 is preferably connected to a fixed or variable voltage.

Positive ions generated at the area of the plane 32 in the beam 6 impinge upon the cathode 3 outside the region 13 or do not impinge upon the cathode at all in the relevant example. With the voltages at the grids 4, 5 only a small number of the ions generated at approximately 100 micrometers from the cathode, are found to impinge upon the emitting part of the cathode, particularly on the layer of cesium, with energies of approximately 40 eV, so that the detrimental effect of positive ions generated in the tube is limited to a slight extent of sputtering of the cesium, whilst crystal damage is prevented. Depending on the voltages at the grids 4, 5 some variations may occur in the distance and energy.

The sensitivity of the cathode may be further reduced by splitting up the emitting region 13 into a plurality of separate regions. Such a structure also enhances the stability of the cathode.

As described in the opening paragraph, the invention may also be used for a vacuum tube having a thermionic cathode. A part of this cathode will not be detrimentally influenced by positive ions, as described above, which leads to a greater stability of the electron emission. Although in this example a device is described in which the axis of the annular emission pattern coincides with that of the tube, this is not strictly necessary. For example, a plurality of cathodes could be used in the case of color display tube, each having an annular pattern 13 which does not coincide with the axis of the tube.

Several variations are of course possible to those skilled in the art within the scope of the invention. For example, the plate 35 may be secured to the grid 37 by means of a smaller number of bars 40 so that the beam current is interrupted to a lesser extent. The plate 35 may alternatively be mounted, for example, in the aperture 39 of the bush 38 so that the grid 37 may be omitted.

Various other types of semiconductor cathodes may alternatively be chosen.

What is claimed is:

1. A cathode-ray tube comprising an evacuated envelope containing, along a longitudinal axis of the envelope, an electron-beam-producing means and a target for impingement by the electron beam, said electron-beam-producing means comprising, in succession along said axis:

(a) a semiconductor cathode having an electron-emitting region surrounding said axis for emitting a hollow beam of electrons;

(b) electrode means for converging the electron beam to a crossover, said electrode means including a first electrode disposed nearby the crossover and having a first opening through which the axis passes, said first opening extending sufficiently far from said axis to pass the converged electron beam; and (c) a second electrode disposed subsequent to the crossover at a location where the hollow electron beam has diverged, said second electrode having a second opening through which the beam passes and an ion barrier member disposed in said second opening at a position where said member will lie within the hollow region of the beam;

said ion barrier member and said first opening being dimensioned such that positive ions travelling toward the cathode which pass through a portion of the second opening which is not occupied by the ion barrier member are trapped by the first electrode;

said first opening and said electron-emitting region of the cathode being dimensioned such that positive ions originating in the region of the electron beam between the first and second electrodes pass through the frist opening and impinge on a region of the cathode lying within the electron-emitting region.

2. A cathode ray tube as in claim 1 where the ion barrier member comprises a plate connected to the second electrode by means of at least one bar.

3. A cathode ray tube as in claim 2 where the bar has a width which does not exceed 100 micrometers.

4. A cathode ray tube as in claim 1, 2 or 3 where the ion barrier member is circular and has a diameter which is larger than the first opening.

5. A cathode ray tube as in claim 4 where the ion barrier member has a diameter which is at least 50 micrometers but not larger than 500 micrometers.

6. A cathode ray tube as in claim 1 where the cathode comprises a semiconductor body having a main surface on which said electron-emitting region is disposed.

7. A cathode ray tube as in claim 6 where the first opening, when viewed in projection along the axis, does not extend sufficiently far from said axis to encompass the electron-emitting region of the cathode.

8. A cathode ray tube as in claim 7 where the electron-emitting region is annular.

9. A cathode ray tube as in claim 8 where the annular electron-emitting region comprises a plurality of discrete electron-emitting sub-regions.

* * * * *